US011377607B2

(12) United States Patent
Sartipi et al.

(10) Patent No.: US 11,377,607 B2
(45) Date of Patent: Jul. 5, 2022

(54) BRANCHED PARAFFINIC COMPOSITIONS DERIVED FROM ISOMERIZED AND HYDROGENATED LINEAR ALPHA OLEFINS

(71) Applicant: ExxonMobil Chemical Patents Inc., Baytown, TX (US)

(72) Inventors: Sina Sartipi, Brussels (BE); Roxana Perez Velez, Kessel-Lo (BE); Silvio Carrettin, Kraainem (BE); Nan Hu, Houston, TX (US); Wenyih Frank Lai, Bridgewater, NJ (US); Daniel Bien, Rheinland Pfalz (DE)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 17/205,106

(22) Filed: Mar. 18, 2021

(65) Prior Publication Data

US 2021/0292663 A1 Sep. 23, 2021

Related U.S. Application Data

(60) Provisional application No. 62/993,184, filed on Mar. 23, 2020.

(51) Int. Cl.
*C10G 69/02* (2006.01)
*C10L 1/04* (2006.01)

(52) U.S. Cl.
CPC ..... *C10G 69/02* (2013.01); *C10L 1/04* (2013.01); *C10G 2300/1088* (2013.01); *C10G 2300/302* (2013.01); *C10G 2300/304* (2013.01); *C10G 2300/4006* (2013.01); *C10G 2300/4012* (2013.01); *C10G 2300/4018* (2013.01); *C10G 2300/4025* (2013.01)

(58) Field of Classification Search
CPC ..... C10G 69/02; C10G 2300/4018; C10G 2300/304; C10G 2300/4025; C10G 2300/1088; C10G 2300/4006; C10G 2300/4012; C10G 2300/302; C10L 1/04
See application file for complete search history.

(56) References Cited

U.S. PATENT DOCUMENTS

| | | | | |
|---|---|---|---|---|
| 4,650,917 | A | 3/1987 | Dessau et al. | 585/329 |
| 7,217,852 | B1 | 5/2007 | DeHaan et al. | 585/734 |
| 7,348,462 | B2 * | 3/2008 | Fenouil | C10G 65/043 585/13 |
| 10,000,712 | B2 | 6/2018 | Novak et al. | C10L 1/08 |
| 2005/0154240 | A1 | 7/2005 | Myburgh et al. | 585/14 |
| 2007/0187292 | A1 | 8/2007 | Miller et al. | 208/15 |
| 2018/0216021 | A1 | 8/2018 | Kuronen et al. | C10L 1/023 |
| 2020/0048525 | A1 | 2/2020 | Germanaud et al. | C09K 8/02 |

OTHER PUBLICATIONS

U.S. Appl. No. 62/993,173, filed Mar. 23, 2020, Sina Sartipi et al.

* cited by examiner

*Primary Examiner* — Thuan D Dang

(57) ABSTRACT

Compositions can include mixtures having from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture. Methods to obtain these compositions can include the isomerization of one or more $C_{10}$-$C_{20}$ alpha olefins under skeletal isomerization conditions to obtain an isomerization mixture and the hydrotreating of the isomerization mixture.

8 Claims, 1 Drawing Sheet

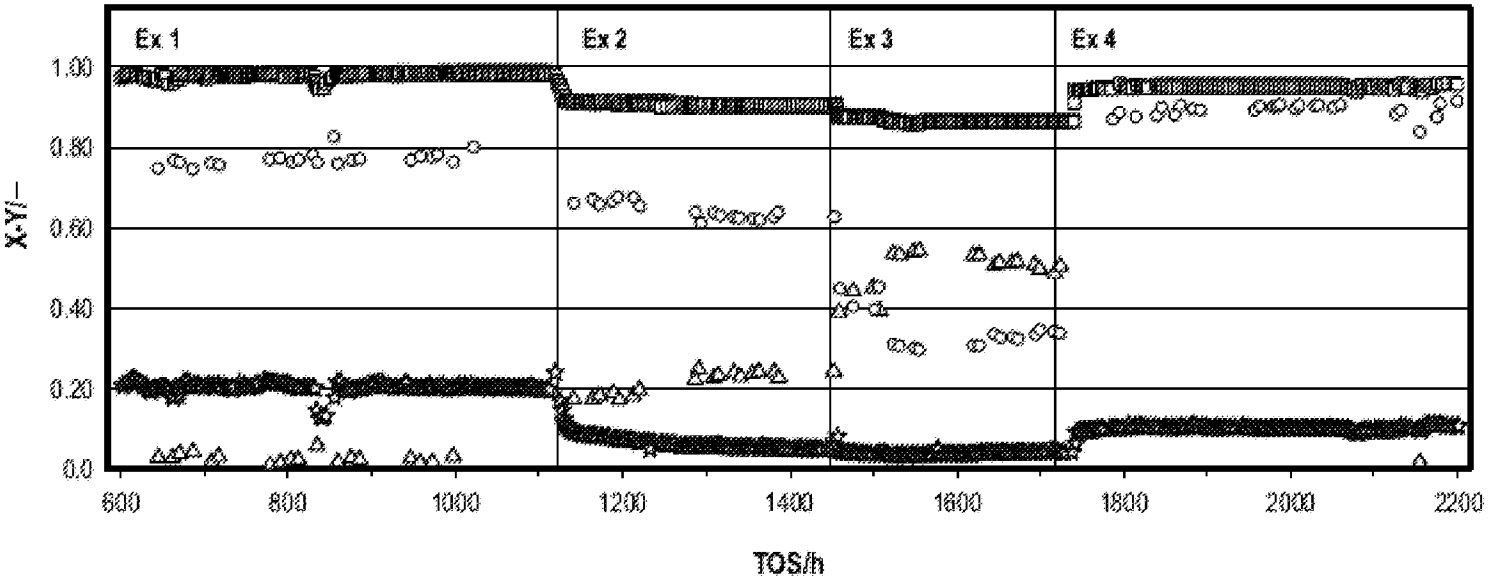
Ex 1
Ex 2
Ex 3
Ex 4
X,Y/–
1.00
0.80
0.60
0.40
0.20
0.0
600
800
1000
1200
1400
1600
1800
2000
2200
TOS/h

BRANCHED PARAFFINIC COMPOSITIONS DERIVED FROM ISOMERIZED AND HYDROGENATED LINEAR ALPHA OLEFINS

CROSS REFERENCE TO RELATED APPLICATIONS

This application claims the benefit of and priority to U.S. Provisional Application No. 62/993,184, filed Mar. 23, 2020, the disclosure of which is incorporated herein by reference.

FIELD OF THE INVENTION

This application relates to compositions of branched saturated hydrocarbons and methods of isomerizing and hydrogenating alpha olefins to produce mixtures comprising branched saturated hydrocarbons.

BACKGROUND

Efforts to improve upon the performance of natural mineral oil-based materials including solvents, lubricants, etc. by the synthesis of oligomeric hydrocarbon fluids have been the subject of important research and development in the petroleum industry for at least 50 years. These efforts have led to the relatively recent market introduction of a number of synthetic lubricants. In terms of lubricant property improvement, the thrust of the industrial research efforts involving synthetic lubricants have been towards fluids exhibiting useful viscosity, biodegradability, pour points, and flash points.

Branched-chain hydrocarbons are commercially valuable fluids suitable for use in a variety of applications including industrial fluids, cleaning agents, and solvent products. In particular, Isopar™ fluid grades are compounds having a high branching that negatively impacts their biodegradability. Further, these highly branched compounds have a relatively high viscosity that negatively impacts their lubricant ability.

Accordingly, there is a renewed interest in developing compositions including and methods of making branched saturated hydrocarbon fluids exhibiting a number of desirable properties, such as biodegradability and low viscosity.

SUMMARY

This application relates to compositions of branched saturated hydrocarbons and methods of isomerizing and hydrogenating alpha olefins to produce mixtures comprising branched saturated hydrocarbons.

Compositions described herein may comprise contacting an olefinic feed comprising one or more $C_{10}$-$C_{20}$ alpha olefins with a catalyst under skeletal isomerization conditions, wherein the catalyst comprises a molecular sieve having an MRE topology; and obtaining an isomerization mixture comprising one or more $C_{10}$-$C_{20}$ branched olefins.

Methods described herein may comprise isomerizing an olefinic feed comprising one or more $C_{10}$-$C_{20}$ alpha olefins under skeletal isomerization conditions to obtain an isomerization mixture; and hydrogenating the isomerization mixture to obtain a hydrogenated mixture, wherein the hydrogenated mixture comprises from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture.

BRIEF DESCRIPTION OF THE DRAWINGS

The following FIGURE is included to illustrate certain aspects of the present disclosure, and should not be viewed as exclusive embodiments. The subject matter disclosed is capable of considerable modifications, alterations, combinations, and equivalents in form and function, as will occur to one of ordinary skill in the art and having the benefit of this application.

The FIGURE depicts the on stream composition of the isomerization mixture resulting from the skeletal isomerization of a linear alpha olefin feed, the isomerization mixture containing linear internal olefins, branched olefins, and $C_{20+}$ olefins. The FIGURE shows the conversion of the linear alpha olefin (squares), and the yields of the linear internal olefins (triangles), branched olefins (circles), and $C_{20+}$olefins (stars) produced in the isomerization reactions conducted in Examples 1-4.

DETAILED DESCRIPTION

This application relates to compositions of branched saturated hydrocarbons and methods of isomerizing and hydrogenating alpha olefins to produce mixtures comprising branched saturated hydrocarbons.

These compositions require a mixture including from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture.

The methods described herein require the isomerization of one or more $C_{10}$-$C_{20}$ alpha olefins under skeletal isomerization conditions to obtain an isomerization mixture and the hydrotreating of the isomerization mixture to obtain a hydrogenated mixture including from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture.

All numerical values within the detailed description and the claims herein are modified by "about" or "approximately" the indicated value, and take into account experimental error and variations that would be expected by a person having ordinary skill in the art. Unless otherwise indicated, room temperature is about 23° C.

Definitions

As used herein, "wt %" means percentage by weight, "vol %" means percentage by volume, "mol %" means percentage by mole, "ppm" means parts per million, and "ppm wt" and "wppm" are used interchangeably to mean parts per million on a weight basis. All "ppm" as used herein are ppm by weight unless specified otherwise. All concentrations herein are expressed on the basis of the total amount of the composition in question. Thus, the concentrations of the various components of the first mixture are expressed based on the total weight of the first mixture. All ranges expressed herein should include both end points as two specific embodiments unless specified or indicated to the contrary.

The term "hydrocarbon" means a class of compounds containing hydrogen bound to carbon, and encompasses (i) saturated hydrocarbon compounds; (ii) unsaturated hydrocarbon compounds; and (iii) mixtures of hydrocarbon compounds (saturated and/or unsaturated), including mixtures of hydrocarbon compounds having different values of n, i.e. differing carbon numbers.

As used herein, and unless otherwise specified, the term "paraffin," alternatively referred to as "alkane," and grammatical derivatives thereof, refers to a saturated hydrocarbon chain of one to about thirty carbon atoms in length, such as, but not limited to methane, ethane, propane and butane. A paraffin may be straight-chain, cyclic or branched-chain. "Paraffin" is intended to embrace all structural isomeric forms of paraffins. The term "acyclic paraffin" refers to straight-chain or branched-chain paraffins. The term "isoparaffin" refers to branched-chain paraffins and the term "n-paraffin" or "normal paraffin" refers to straight-chain paraffins.

As used herein, a "carbon number" refers to the number of carbon atoms in a hydrocarbon. Likewise, a "$C_x$" hydrocarbon is one having x carbon atoms (i.e., carbon number of x), and a "$C_x$-$C_y$" or "$C_{x-y}$," hydrocarbon is one having from x to y carbon atoms.

The term "alkane" refers to non-aromatic saturated hydrocarbons with the general formula $C_nH_{(2n+2)}$, where n is 1 or greater. An alkane may be straight chained or branched. Examples of alkanes include, but are not limited to methane, ethane, propane, butane, pentane, hexane, heptane and octane. "Alkane" is intended to embrace all structural isomeric forms of an alkane. For example, butane encompasses n-butane and isobutane; pentane encompasses n-pentane, isopentane and neopentane.

The term "olefin," alternatively referred to as "alkene," refers to a branched or unbranched unsaturated hydrocarbon having one or more carbon-carbon double bonds. A simple olefin comprises the general formula $C_nH_{2n}$, where n is 2 or greater. Examples of olefins include, but are not limited to ethylene, propylene, butylene, pentene, hexene and heptene. "Olefin" is intended to embrace all structural isomeric forms of an olefin. For example, butylene encompasses but-1-ene, (Z)-but-2-ene, etc. An olefin may be straight-chain or branched-chain. "Olefin" is intended to embrace all structural isomeric forms of olefins.

As used herein, the term "molecular sieve" is used synonymously with the term "zeolite" or "microporous crystalline material."

As used herein, the term "reactor" refers to any vessel(s) in which a chemical reaction occurs. Reactor includes both distinct reactors, as well as reaction zones within a single reactor apparatus and, as applicable, reactions zones across multiple reactors. For example, a single reactor may have multiple reaction zones. Where the description refers to a first and second reactor, the person of ordinary skill in the art will readily recognize such reference includes two reactors, as well as a single reactor vessel having first and second reaction zones. Likewise, a first reactor effluent and a second reactor effluent will be recognized to include the effluent from the first reaction zone and the second reaction zone of a single reactor, respectively.

Various embodiments described herein provide compositions containing a high content of $C_{10}$-$C_{20}$ branched paraffins. These compositions may be prepared via the skeletal isomerization, typically a catalytic isomerization, of one or more $C_{10}$-$C_{20}$ alpha olefins, following by the hydrotreating of the resulting product, which may contain a mixture of $C_{10}$-$C_{20}$ branched olefins, $C_{10}$-$C_{20}$ linear internal olefins, $C_{20+}$ olefins, and unreacted $C_{10}$-$C_{20}$ alpha olefins. It has been found that employing molecular sieve catalysts having an MRE topology in the isomerization advantageously allows for the selective skeletal isomerization of the alpha olefins into branched olefin in a high yield. Additionally, it has been found that such catalysts are particularly effective in controlling branched olefin formation in the produced isomerization mixture. Generally, the resulting isomerization mixture comprises a maximized branched olefin content and minimized linear olefin and $C_{20+}$ olefin contents. For example, the isomerization of the $C_{10}$-$C_{20}$ alpha olefinic feed using a catalyst having a molecular sieve having an MRE framework topology results in a conversion of the $C_{10}$-$C_{20}$ alpha olefins to $C_{10}$-$C_{20}$ branched olefins, $C_{10}$-$C_{20}$ linear internal olefins, and $C_{20+}$ olefins. The resulting isomerization mixture may subsequently be subjected to hydrotreating, typically under catalytic hydrogenation conditions, to produce a hydrogenated mixture, which may comprise from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture.

Olefinic Feed

Generally, the alpha olefins supplied to the isomerization have a carbon number ranging from 10 to 20, more preferably from 12 to 18, more preferably from 12 to 16, and ideally from 12 to 14. Preferably, the alpha olefins supplied to the isomerization are linear alpha olefins.

Typically, the one or more $C_{10}$-$C_{20}$ alpha olefins are provided in an olefinic feed. Suitable olefinic feeds for use in various embodiments of the present invention comprise (or consist essentially of, or consist of) $C_{10}$-$C_{20}$ alpha olefins, preferably $C_{12}$-$C_{18}$ alpha olefins, such as $C_{12}$-$C_{16}$ alpha olefins, ideally $C_{12}$-$C_{14}$ alpha olefins. In any embodiment, at least about 50 wt %, preferably at least about 60 wt %, more preferably at least about 80 wt %, more preferably at least about 85 wt %, more preferably at least about 95 wt %, more preferably at least about 99 wt % of the olefinic feed is composed of alpha olefins, preferably alpha olefins, having any of the aforementioned $C_x$-$C_y$ ranges (i.e., any of the aforementioned numbers of carbon atoms) based on the total weight of the olefinic feed. For example, in any embodiment the olefinic feed may comprise from about 40 wt % to 100 wt %, such as from about 75 wt % to about 90 wt %, of alpha olefins, preferably linear alpha olefins, having any of the aforementioned $C_x$-$C_y$ ranges based on the total weight of the olefinic feed. Particularly preferable olefinic feeds may comprise $C_{12}$-$C_{16}$ alpha olefins, ideally $C_{12}$-$C_{14}$ linear alpha olefin mixtures. In such aspects, the olefinic feed typically comprises at least about 40 wt % of $C_{14}$ alpha olefins, more preferably at least about 60 wt %, such as at least about 65 wt % of $C_{14}$ alpha olefins (preferably linear $C_{14}$ alpha olefins) based on the total weight of the olefinic feed and, additionally or alternatively, at most about 60 wt %, more preferably at most about 40 wt %, such as at most about 35 wt % of $C_{14}$ alpha olefins (preferably linear $C_{14}$ alpha olefins) based on the total weight of the olefinic feed, such as from about 60 wt % or from about 65 wt % to 75 wt % of $C_{14}$ alpha olefins and from about 25% to about 40 wt % or to about 35 wt % $C_{14}$ alpha olefins based on the total weight of the olefinic feed.

In any embodiment, the olefinic feed preferably has an average carbon number (by weight, as measured by GC-MS) of greater than or equal to 12, preferably less than or equal to 16, such as from 12 to 16.

Typically, the olefinic feed is substantially linear. For example, the olefinic feed typically has a branched olefin content of less than or equal to about 10 wt % based on the total weight of the olefinic feed, preferably less than or equal to about 8 wt %, more preferably less than or equal to about 4 wt %, such as from 0 wt % to 10 wt % branched olefin content based on the total weight of the olefinic feed.

Preferably, the olefinic feed is pretreated prior to isomerization to remove moisture, oxygenates, nitrates, and other impurities that could deactivate the isomerization catalyst. Typically, the pretreatment is performed by passing the feed through a guard bed that contains a molecular sieve. Typically, the pretreated feed comprises less than or equal to about 50 ppmw water based on the weight of the feed, more preferably less than or equal to about 25 ppmw.

Skeletal Isomerization Catalyst

Generally, the isomerization is conducted in the presence of a catalyst. Typically, the isomerization catalyst comprises (or consists essentially of, or consists of) a molecular sieve of the MRE family. Preferably, the molecular sieve is of the ZSM-48 family. The term "ZSM-48 family material" (or "material of the ZSM-48 family" or "molecular sieve of the ZSM-48 family"), as used herein, includes one or more of:

- molecular sieves made from a common first degree crystalline building block unit cell, which unit cell has the MRE framework topology (a unit cell is a spatial arrangement of atoms which if tiled in three-dimensional space describes the crystal structure. Such crystal structures are discussed in the "Atlas of Zeolite Framework Types," Fifth edition, 2001, the entire content of which is incorporated as reference);
- molecular sieves made from a common second degree building block, being a 2-dimensional tiling of such MRE framework topology unit cells, forming a monolayer of one unit cell thickness, preferably one c-unit cell thickness;
- molecular sieves made from common second degree building blocks, being layers of one or more than one unit cell thickness, wherein the layer of more than one unit cell thickness is made from stacking, packing, or binding at least two monolayers of one unit cell thickness. The stacking of such second degree building blocks can be in a regular fashion, an irregular fashion, a random fashion, or any combination thereof; and
- molecular sieves made by any regular or random 2-dimensional or 3-dimensional combination of unit cells having the MRE framework topology.

More particularly, ZSM-48 includes a family of materials having tubular pores. The pores are formed of rolled up honeycomb-like sheets of fused T6-rings (T=tetrahedral), and the pore aperture contains 10 T-atoms. Neighboring pores are related by a zero shift along the pore direction or by a shift of half the repeat distance along the pore direction.

Molecular sieves of the ZSM-48 family generally have an X-ray diffraction pattern including d-spacing maxima at 11.8±0.2, 10.2±0.2, 7.2±0.15, 4.2±0.08, 3.9±0.08, 3.6±0.06, 3.1±0.05 and 2.85±0.05 Angstrom. The X-ray diffraction data used to characterize the material are obtained by standard techniques using the K-alpha doublet of copper as the incident radiation and a diffractometer equipped with a scintillation counter and associated computer as the collection system.

Molecular sieves of the ZSM-48 (ZSM-48 and the conventional preparation thereof are taught by U.S. Pat. No. 4,375,573) may include pure ZSM-48 crystals. Substantially pure ZSM-48 crystals are defined herein as ZSM-48 crystals that contain less than or equal to about 20 wt % of another type of zeolite and/or impurity, such as ZSM-50 or Kenyaite. Preferably, the substantially pure ZSM-48 crystals can contain less than or equal to about 15 wt % of another type of zeolite, such as less than 10 wt % of another type of zeolite, or less than or equal to about 5 wt % of another type of zeolite. More preferably, the substantially pure ZSM-48 crystals can contain less than or equal to about 20 wt % of another type of zeolite (such as ZSM-50) or an impurity such as Kenyaite. In such aspects, the substantially pure ZSM-48 crystals can contain less than or equal to about 15 wt % of another type of zeolite or impurity, such as less than or equal to about 10 wt % of another type of zeolite or impurity, or less than or equal to about 5 wt % of another type of zeolite or impurity, and mixtures thereof. The molecular sieves of the ZSM-48 family may also include post-synthesis crystallites such as steamed versions.

Additionally, the molecular sieve of the ZSM-48 family (MRE topology) has a $Si/Al_2$ molar ratio of less than or equal to 200, or of about 50 to about 200, or of about 60 to about 175, or of about 65 to about 150, or of about 70 to about 125, or of about 80 to about 100, or of about 85 to about 95.

The isomerization catalyst may be composited with a porous matrix binder material such as clay and/or inorganic oxides. The latter may be either naturally occurring or in the form of gelatinous precipitates or gels including mixtures of silica and metal oxides. Naturally occurring clays which can be used as a binder include those of the montmorillonite and kaolin families, which families include the subbentonites and the kaolins commonly known as Dixie, McNamee, Georgia and Florida clays or others in which the main mineral constituent is halloysite, kaolinite, dickite, nacrite or anauxite. Such clays can be used in the raw state as originally mined or initially subjected to calcination, acid treatment or chemical modification. Suitable inorganic oxide binders include silica, alumina, zirconia, titania, silica-alumina, silica-magnesia, silica-zirconia, silica-thoria, silica-beryllia, silica-titania as well as ternary compositions such as silica-alumina-thoria, silica-alumina-zirconia, silica-alumina-magnesia and silica-magnesia-zirconia. It may also be advantageous to provide at least a part of the foregoing porous matrix binder material in colloidal form to facilitate extrusion of the catalyst composition. Typically, the binder material may be present from about 0 wt % to about 90 wt % based on the weight of the isomerization catalyst, such as from about 20 wt % to about 50 wt %.

Alternately, the isomerization catalyst may be substantially free of binder, or free of binder. Typically, the isomerization catalyst is free or substantially free of additional components apart from the molecular, binder (if present), and optionally, trace amounts of alkali and/or alkali earth metals or compounds thereof. For example, in any embodiment the isomerization catalyst may be free or substantially free from promoters, such as noble metals and transition metals in metal or metal oxide form, e.g., platinum, palladium, ruthenium, iron, cobalt, and nickel. For instance, preferably the isomerization catalyst may comprise a combined platinum, palladium, ruthenium, iron, cobalt, and nickel content of less than or equal to about 0.5 wt % based on the weight of the isomerization catalyst, more preferably less than or equal to about 0.1 wt % or less than or equal to about 0.01 wt %.

Molecular sieves having an MRE topology have been found to be particularly active for the skeletal isomerization of $C_{10}$-$C_{20}$ linear alpha olefins. In addition, such catalysts exhibit improved selectivity towards branched internal olefins while also providing improved control of $C_{20+}$ olefin formation.

Isomerization of Olefins

The isomerization reaction can be conducted in a wide range of reactor configurations including fixed bed (single or in series) and fluidized bed, preferably fixed bed. In addition, the isomerization can be conducted in a single reaction zone or in a plurality of reaction zones.

Typically, the isomerization is conducted under conditions suitable to maintain the reaction medium in the liquid phase. Preferably, the isomerization is conducted under mild process conditions, particularly at low temperature. Suitable reaction temperatures range from at least about 100° C., such as from about 100° C. to about 300° C., such as from about 100° C. to about 200° C., such as from about 120° C. to about 190° C., or from about 140° C. to about 180° C., or from about 150° C. to about 170° C., while suitable isomerization pressures range from about 0.5 barg to about 2 barg, or more preferably from about 1 barg to about 2 barg. Preferably, the olefinic feed is supplied to the reaction at a weight hourly space velocity (WHSV) ranging from about 1 $h^{-1}$ to about 50 $h^{-1}$, more preferably from about 1 $h^{-1}$ to about 20 $h^{-1}$, more preferably from about 1 $h^{-1}$ to about 10 $h^{-1}$, wherein the WHSV is the weight of feed flowing per unit weight of the catalyst per hour. The temperature ranges may also vary with the activity loss of the catalyst, e.g., the temperature range may be increased to compensate for catalyst activity losses.

Typically, the isomerization exhibits a high single-pass rate of conversion (measured as 100 minus the remaining amount of linear alpha olefins expressed in wt %, as measured by GC). For example, preferably the single-pass rate of conversion of the one or more $C_{10}$-$C_{20}$ alpha olefins is from about 5% to about 98%, more preferably from about 20% to about 98%. In such aspects, the isomerization can be conveniently conducted in the absence of recycle, i.e., without recycling any portion of the produced isomerization mixture. Preferably, conducting the isomerization without recycle provides several process advantages, such as increasing process reliability and reducing operating costs.

Preferably, the isomerization reaction is highly selective to the desired branched olefin products, and exhibits minimal side reactions, such as oligomerization, and cracking. For example, typically less than or equal to about 30 wt % of $C_{10}$-$C_{20}$ alpha olefins present in the olefinic feed are converted to product having a lower or higher carbon number. Additionally or alternatively, typically less than or equal to about 30 wt % of linear $C_{10}$-$C_{20}$ alpha olefins present (if any) in the olefinic feed are converted to $C_{20+}$ olefins.

In any embodiment, the branched olefins obtained in the isomerization mixture may be particularly useful as intermediates for hydrogenation for fluid applications. Preferred isomerization mixtures suitable for these applications may comprise from about 60 wt % to about 98 wt %, preferably from about 65 wt % to about 95 wt %, such as from about 70 wt % to about 90 wt %, or from about 75 wt % to about 85 wt % of $C_{10}$-$C_{20}$ branched olefins based on the total weight of the isomerization mixture. In addition, isomerization mixtures suitable for these applications may comprise from about 2 wt % to about 40 wt %, such as 2 wt % to about 35 wt %, for example from about 5 wt % to about 30 wt % of $C_{10}$-$C_{20}$ linear internal olefins. The isomerization mixture may further comprise less than or equal to about 30 wt % of $C_{20+}$ olefins, such as less than or equal to about 25 wt %, or less than or equal to about 20 wt %, or less than or equal to about 15 wt % of $C_{20+}$ olefins.

Hydrogenation of the Isomerized Olefin Mixture

Hydrogenation or hydrotreating of the isomerized olefin mixture yields a saturated hydrocarbon mixture comprising from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture. The reaction with hydrogen may occur in the presence of a hydrogenation catalyst. Suitable hydrogenation catalysts are transition metals such as Cr, Mo, W, Fe, Rh, Co, Ni, Pd, Pt, Ru, etc., or mixtures thereof, which may be applied to supports such as activated carbon or aluminum oxide, to increase the activity and stability.

The saturated branched hydrocarbons can be isolated in pure form from the saturated hydrocarbon mixture obtained from the hydrogenation by purification methods known to those skilled in the art, such as fractional distillation.

Saturated Hydrocarbon Mixture

The resulting saturated hydrocarbon mixture obtained via isomerization of the one or more $C_{10}$-$C_{20}$ alpha olefins followed by hydrotreating of the isomerized olefin mixture according to any one or more of the foregoing embodiments typically comprises (or consists essentially of, or consists of) linear paraffins, branched saturated hydrocarbons, and, optionally, $C_{20+}$ saturated hydrocarbons. For example, the hydrogenated or hydrotreated mixture preferably has a branched saturated hydrocarbon content of from about 60 wt % to about 98 wt %, preferably from about 65 wt % to about 95 wt %, such as from about 70 wt % to about 90 wt %, or from about 75 wt % to about 85 wt % based on the total weight of the hydrogenated or hydrotreated mixture. The hydrogenated or hydrotreated mixture may further comprise from 2 wt % to about 40 wt %, preferably from about 2 wt % to about 35 wt %, more preferably from about 5 wt % to about 30 wt % of linear paraffins based on the total weight of the hydrogenated or hydrotreated mixture. The hydrogenated or hydrotreated mixture may further comprise less than or equal to about 30 wt % of $C_{20+}$ saturated hydrocarbons, such as less than or equal to about 25 wt %, or less than or equal to about 20 wt %, or less than or equal to about 15 wt % of $C_{20+}$saturated hydrocarbons.

For example, in a first alternative, the hydrogenated or hydrotreated mixture may comprise from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture.

For example, in another alternative, the hydrogenated or hydrotreated mixture may comprise from about 2 wt % to about 40 wt % of $C_{10}$ linear paraffins based on the weight of the mixture, from about 60 wt % to about 98 wt % of $C_{10}$ branched saturated hydrocarbons based on the weight of the mixture, and less than or equal to about 30 wt % of $C_{20+}$ saturated hydrocarbons based on the weight of the mixture.

For example, in another alternative, the hydrogenated or hydrotreated mixture may comprise from about 2 wt % to about 40 wt % of $C_{12}$ linear paraffins based on the weight of the mixture, from about 60 wt % to about 98 wt % of $C_{12}$ branched saturated hydrocarbons based on the weight of the mixture, and less than or equal to about 30 wt % of $C_{20+}$ saturated hydrocarbons based on the weight of the mixture.

For example, in another alternative, the hydrogenated or hydrotreated mixture may comprise from about 2 wt % to about 40 wt % of $C_{14}$ linear paraffins based on the weight of the mixture, from about 60 wt % to about 98 wt % of $C_{14}$ branched saturated hydrocarbons based on the weight of the mixture, and less than or equal to about 30 wt % of $C_{20+}$ saturated hydrocarbons based on the weight of the mixture.

For example, in another alternative, the hydrogenated or hydrotreated mixture may comprise from about 2 wt % to about 40 wt % of $C_{16}$ linear paraffins based on the weight of the mixture, from about 60 wt % to about 98 wt % of $C_{16}$ branched saturated hydrocarbons based on the weight of the mixture, and less than or equal to about 30 wt % of $C_{20+}$ saturated hydrocarbons based on the weight of the mixture.

For example, in another alternative, the hydrogenated or hydrotreated mixture may comprise from about 2 wt % to about 40 wt % of $C_{18}$ linear paraffins based on the weight of the mixture, from about 60 wt % to about 98 wt % of $C_{18}$ branched saturated hydrocarbons based on the weight of the mixture, and less than or equal to about 30 wt % of $C_{20+}$ saturated hydrocarbons based on the weight of the mixture.

For example, in another alternative, the hydrogenated or hydrotreated mixture may comprise from about 2 wt % to about 40 wt % of $C_{20}$ linear paraffins based on the weight of the mixture, from about 60 wt % to about 98 wt % of $C_{20}$ branched saturated hydrocarbons based on the weight of the mixture, and less than or equal to about 30 wt % of $C_{20+}$ saturated hydrocarbons based on the weight of the mixture.

The hydrogenated or hydrotreated mixture may comprise less than or equal to about 25 wt % of naphthene, such as less than or equal to about 24 wt % of naphthalene. Additionally, the hydrogenated or hydrotreated mixture may comprise less than or equal to about 1 wt % of aromatics, such as less than or equal to about 0.9 wt % of aromatics, such as less than or equal to about 0.5 wt % of aromatics, such as less than or equal to about 0.1 wt % of aromatics.

To characterize the saturated branched hydrocarbon compositions, gas chromatographic and nuclear magnetic resonance methods were employed. In particular, the degree of branching was obtained from a model applied to gas chromatography and nuclear magnetic resonance data of the sample. For example, in an alternative, the degree of branching of the composition was at least 0.60, such as from 0.60 to 4.00, or from 0.65 to 3.50, or from 0.70 to 3.00.

For example, in another alternative, the composition has a pour point of about −10° C. or less, such as −20° C. or less, such as −40° C. or less, such as −50° C. or less, such as −60° C. or less, such as −65° C. or less.

For example, in an alternative, the composition has a kinematic viscosity at 25° C. of from about 1.0 cSt to about 5.0 cSt, such as from about 2.0 cSt to about 4.0 cSt, such as from about 2.25 cSt to about 3.75 cSt.

For example, in another alternative, the composition has a flash point temperature of from about 90° C. to about 100° C., such as from about 93° C. to about 99° C.

EXAMPLE EMBODIMENTS

Embodiments disclosed herein include Embodiment A and Embodiment B.

Embodiment A: A composition comprising from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture.

Embodiment A may have one or more of the following additional elements in any combination:

Element 1: wherein the composition has a degree of branching of at least 0.60.

Element 2: wherein the composition comprises from about 2 wt % to about 40 wt % of $C_{10}$-$C_{14}$ linear paraffins based on the weight of the mixture.

Element 3: wherein the composition comprises from about 60 wt % to about 98 wt % of $C_{10}$-$C_{14}$ branched saturated hydrocarbons based on the weight of the mixture.

Element 4: wherein the composition comprises from about 60 wt % to about 75 wt % of $C_{14}$ branched saturated hydrocarbons based on the weight of the mixture.

Element 5: wherein the composition has a pour point of about −10° C. or less.

Element 6: wherein the composition has a pour point of about −40° C. or less.

Element 7: wherein the composition has a pour point of about −65° C. or less.

Element 8: wherein the composition has a kinematic viscosity at 25° C. of from about 1.0 cSt to about 5.0 cSt.

Element 9: wherein the composition has a kinematic viscosity at 25° C. of from about 2.0 cSt to about 4.0 cSt.

Element 10: wherein the composition has a kinematic viscosity at 25° C. of from about 2.25 cSt to about 3.75 cSt.

Element 11: wherein the composition has a flash point temperature of from about 90° C. to about 100° C.

Element 12: wherein the composition has a flash point temperature of from about 93° C. to about 99° C.

Element 13: wherein the composition comprises less than or equal to about 25 wt % of naphthene.

Element 14: wherein the composition comprises less than or equal to about 1 wt % of aromatics.

Embodiment A may have one or more of the following additional elements in any combination: Elements 1-14. In addition, by way of non-limiting example, exemplary combinations applicable to Embodiment A include: combinations of Elements 1 and 2; combinations of Elements 1-3; combinations of Elements 1-4; combinations of Elements 1-5; combinations of Elements 1-6; combinations of Elements 1-7; combinations of Elements 1-8; combinations of Elements 1-9; combinations of Elements 1-10; combinations of Elements 1-11; combinations of Elements 1-12; combinations of Elements 1-13; combinations of Elements 1-14; combinations of Elements 2 and 3; combinations of Elements 2, 3, and 4; combinations of Elements 5 and 6; combinations of Elements 7, 8, and 9; combinations of Element 1 with one or more of Elements 2-14; combinations of Element 2 with one or more of Elements 3-14; combination of Element 3 with one or more of Elements 4-14; combination of Element 4 with one or more of Elements 5-14; combination of Element 5 with one or more of Elements 6-14; combination of Element 6 with one or more of Elements 7-14; combination of Element 7 with one or more of Elements 8-14; combination of Element 8 with one or more of Elements 9-14; combination of Element 9 with one or more of Elements 10-14; combination of Element 10 with one or more of Elements 11-14; combination of Element 11 with one or more of Elements 12-14; combination of Element 12 with Elements 13 and 14.

Embodiment B: A method comprising: isomerizing an olefinic feed comprising one or more $C_{10}$-$C_{20}$ alpha olefins under skeletal isomerization conditions to obtain an isomerization mixture; and hydrogenating the isomerization mixture to obtain a hydrogenated mixture, wherein the hydrogenated mixture comprises from about 2 wt % to about 40 wt % of $C_{10}$-$C_{20}$ linear paraffins based on the weight of the mixture, from about 60 wt % to about 98 wt % of $C_{10}$-$C_{20}$ branched saturated hydrocarbons based on the weight of the mixture, and less than or equal to about 30 wt % of $C_{20+}$ saturated hydrocarbons based on the weight of the mixture.

Embodiment B may have one or more of the following additional elements in any combination:

Element 15: wherein the olefinic feed is isomerized with a catalyst comprising a molecular sieve having an MRE topology.

Element 16: wherein the molecular sieve is of the ZSM-48 family.

Element 17: wherein the isomerization mixture is hydrogenated with a hydrogenation catalyst.

Element 18: wherein the olefinic feed is supplied at a weight hourly space velocity from about 1 to about 10 $h^{-1}$.

Embodiment B may have one or more of the following additional elements in any combination: Elements 15-18. In addition, by way of non-limiting example, exemplary combinations applicable to Embodiment B include: combinations of Elements 15 and 16; combinations of Elements 16 and 17; combinations of Elements 17 and 18; and combination of Element 15 with one or more of Elements 16-18.

To facilitate a better understanding of the embodiments described herein, the following examples of various representative embodiments are given. In no way should the following examples be read to limit, or to define, the scope of the present disclosure.

EXAMPLES

Examples 1-4

Skeletal isomerization of a $C_{14}$ linear alpha olefin feed was carried out by streaming the olefin feed containing>99.5 wt % $C_{14}$ with ca. 95 wt % linear alpha olefins and ca. 0.2 wt % paraffins over a ZSM-48-based zeolite catalyst at various process conditions shown in Table 1.

TABLE 1

| Examples | T (° C.) | Pressure (barg) | WHSV ($h^{-1}$) | Conversion range (%) | Linear internal olefin yield (%) | Branched olefin yield (%) | $C_{20+}$ olefin yield (%) |
|---|---|---|---|---|---|---|---|
| Example 1 | 180 | 1.5 | 1 | 90-100 | 0-10 | 70-90 | 15-25 |
| Example 2 | 180 | 1.5 | 5 | 85-95 | 15-25 | 50-70 | 5-15 |
| Example 3 | 170 | 1.5 | 5 | 80-90 | 35-55 | 20-45 | 0-10 |
| Example 4 | 170 | 1.5 | 1 | 90-100 | 0-10 | 80-100 | 5-15 |

Occasionally trans-decalin (Merck, 821745) was added into the feed as internal standard in order to determine the mass-balance. Once a reasonable mass-balance was assured, no internal standard was used. The reaction yields were collected after 64 hours on-stream. Three reactions were identified, namely, a double-bond shift converting the $C_{14}$ linear alpha olefins into linear internal olefins, a skeletal isomerization converting the $C_{14}$ linear alpha olefins into branched hydrocarbons, and into $C_{20+}$ olefins. The reaction yields of the isomerization reactions of the $C_{14}$ linear alpha olefins are shown in The FIGURE. The FIGURE also shows the changes of the on stream composition of the olefin changed with time on stream (TOS).

Examples 5-9

The isomerized olefin fluid samples of Examples 1, 2, and 4 were used as the olefin feed for the hydrogenation step. Additionally, liquid samples of Examples 1 and 4, which contained noticeable amounts of $C_{20+}$, were distilled to separate the $C_{14}$ fraction. Subsequently, the five olefin samples were hydrogenated in a batch reactor in order to generate five $C_{14}$ fluids including saturated hydrocarbons. The conversion from olefins to saturated hydrocarbons can be achieved using well known hydrogenation technologies. Example 5 was obtained from the hydrogenation of an olefin sample of Example 1. Example 6 was obtained from the hydrogenation of a distilled fraction of Example 1. Example 7 was obtained from the hydrogenation of an olefin sample of Example 2. Example 8 was obtained from the hydrogenation of an olefin sample of Example 4. Example 9 was obtained from the hydrogenation of a distilled fraction of Example 4.

The following properties of Examples 5-9 were analyzed: pour point, kinematic viscosity, degree-of-branching, carbon number distribution, flash point, and composition.

Two known hydrocarbons were also analyzed. Namely, an n-$C_{14}$ sample obtained from the hydrogenation of the $C_{14}$ linear alpha olefin feed (Comparative 1) and a sample of Isopar™ M Fluid (Comparative 2).

The physical and compositional properties of Examples 5-9 and Comparatives 1 and 2 are presented in Table 2 and 3, respectively.

TABLE 2

| Examples | $T_{pour\ point}$[a] (° C.) | $\nu_{@25°\ C.}$ (cSt) | Degree of branching[d] (branch per molecule) | $T_{flash\ point}$ (° C.) |
|---|---|---|---|---|
| Example 5 | −69 | 3.69[b] | 1.90 | 95[f] |
| Example 6 | −92 | 2.44[b] | 1.54 | 93[f] |

TABLE 2-continued

| Examples | $T_{pour\ point}$[a] (° C.) | $\nu_{@25°\ C.}$ (cSt) | Degree of branching[d] (branch per molecule) | $T_{flash\ point}$ (° C.) |
|---|---|---|---|---|
| Example 7 | −15 | 2.75[b] | 0.76 | N/D |
| Example 8 | −66 | 2.93[b] | 1.24 | 99[g] |
| Example 9 | −39 | 2.53[b] | 1.09 | 97[g] |
| Comparative 1 | 6 | 2.67[b] | 0.04 | N/D |
| Comparative 2 | −90 | 4.33[c] | 4.39 | N/D |

[a]Pour point measured according to ASTM D5950.

[b]Kinematic viscosity measured according to ASTM D7042.

[c]Kinematic viscosity measured according to FPA 7042.

[d]Obtained from a model, applied to gas chromatography and nuclear magnetic resonance data.

[e] Not determined.

[f]Flash point measured according to ASTM D93.

[g]Flash point measured according to ASTM 7094.

TABLE 3

| Examples | $x^a$ (wt %) | | | $x^b$ (wt %) | | | |
|---|---|---|---|---|---|---|---|
| | $C_{10}$-$C_{14}$ | $C_{15}$-$C_{20}$ | $C_{20+}$ | Paraffin | Isoparaffin | Naphthene | Aromatic |
| Example 5 | 79.0 | 0.6 | 20.0 | 2.0 | 73.8 | 24.1 | 0.0 |
| Example 6 | 99.0 | 0.4 | 0.0 | 2.2 | 83.3 | 14.5 | 0.0 |
| Example 7 | 96.2 | 0.4 | 3.0 | 32.4 | 67.5 | 0.1 | 0.0 |
| Example 8 | 91.8 | 0.4 | 8.0 | 8.2 | 82.8 | 9.0 | 0.0 |
| Example 9 | 99.6 | 0.4 | 0.0 | 9.1 | 90.8 | 0.1 | 0.0 |
| Comparative 1 | 99.6 | 0.3 | 0.0 | 94.8 | 5.2 | 0.0 | 0.0 |
| Comparative 2 | 75.7 | 24.3 | 0.0 | 0.0 | 88.0 | 11.7 | 0.3 |

[a]Mass fraction/carbon number distribution obtained from gas chromatography.
[b]Mass fraction obtained from PINA analysis according to ASTM 2786.
[c]Not determined.

The pour point and viscosity of $C_{14}$ linear paraffin (Comparative 1) were 6° C. and 2.67 cSt, respectively. The pour point of $C_{14}$ decreased dramatically upon skeletal isomerization (Examples 5-9, Table 2).

The lowest obtained pour point was −92° C. for Example 6 which is similar to that of Isopar™ M Fluid (Comparative 2). However, the viscosity of Example 6 was significantly lower than that of Isopar™ M Fluid (2.44 cSt vs. 4.33 cSt, respectively). This is due to the controlled skeletal isomerization and a narrower carbon number distribution that results in a lower degree-of-branching for Example 6 as compared with Isopar™ M Fluid (1.54 vs. 4.39 branches per molecule, respectively; Table 2).

Example 7 contained the lowest amount of $C_{20+}$ among the un-distilled Examples (Table 3) and the lowest viscosity (2.75 cSt, Table 2). With 0.76 branch per molecule, the pour point of Example 7 was −15° C. which may still be suitable for some applications.

The presence of $C_{20+}$ increased the viscosity from 2.44 cSt to 3.69 cSt as shown in Examples 6 and 5 and from 2.53 cSt to 2.93 cSt as shown Example 9 and 8, respectively. In spite of this increase, the viscosity of Example 8 (containing 8 wt % $C_{20+}$) was close or superior to those of the comparative examples. Additionally, Example 8 had a the highest flash point of 99° C.

All documents described herein are incorporated by reference herein for purposes of all jurisdictions where such practice is allowed, including any priority documents and/or testing procedures to the extent they are not inconsistent with this text. As is apparent from the foregoing general description and the specific embodiments, while forms of the disclosure have been illustrated and described, various modifications can be made without departing from the spirit and scope of the disclosure. Accordingly, it is not intended that the disclosure be limited thereby.

Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa. The term "and/or" as used in a phrase such as "A and/or B" herein is intended to include "A and B," "A or B," "A," and "B." Numerical ranges used herein include the numbers recited in the range. For example, the numerical range "from 1 wt % to 10 wt %" includes 1 wt % and 10 wt % within the recited range.

The invention claimed is:

1. A composition comprising:

from about 2 wt % to about 40 wt % of $C_{10}$-$C_{20}$ linear paraffins based on the weight of the mixture;

from about 60 wt % to about 98 wt % of $C_{10}$-$C_{20}$ branched saturated hydrocarbons based on the weight of the mixture;

less than or equal to about 30 wt % of $C_{20+}$saturated hydrocarbons based on the weight of the mixture; and from about 60 wt % to about 75 wt % of $C_{14}$ branched saturated hydrocarbons based on the weight of the mixture, wherein the composition has a pour point of about −65° C. or less measured according to ASTM D5950, and the composition has a kinematic viscosity at 25° C. of from about 2.25 cSt to about 3.75 cSt measured according to ASTM D7042.

2. The composition of claim 1, wherein the composition has a degree of branching of at least 0.60.

3. The composition of claim 1, wherein the composition comprises from about 2 wt % to about 40 wt % of $C_{10}$-$C_{14}$ linear paraffins based on the weight of the mixture.

4. The composition of claim 1, wherein the composition comprises from about 60 wt % to about 98 wt % of $C_{10}$-$C_{14}$ branched saturated hydrocarbons based on the weight of the mixture.

5. The composition of claim 1, wherein the composition has a flash point temperature of from about 90° C. to about 100° C.

6. The composition of claim 1, wherein the composition has a flash point temperature of from about 93° C. to about 99° C.

7. The composition of claim 1, wherein the composition comprises less than or equal to about 25 wt % of naphthene.

8. The composition of claim 1, wherein the composition comprises less than or equal to about 1 wt % of aromatics.

* * * * *